United States Patent [19]

Doster

[11] 4,363,141

[45] Dec. 14, 1982

[54] QUILT FOR USE IN WHEELCHAIRS

[76] Inventor: Elizabeth Doster, 966 Glennan Dr., Redwood City, Calif. 94061

[21] Appl. No.: 211,263

[22] Filed: Nov. 28, 1980

[51] Int. Cl.[3] ..... A41B 1/12

[52] U.S. Cl. ..... 2/69.5

[58] Field of Search ..... 2/69.5, 69, 70 R, 71, 2/72

[56] References Cited

U.S. PATENT DOCUMENTS

| | | | |
|---|---|---|---|
| 633,134 | 9/1899 | Hansen | 2/69 |
| 1,406,764 | 2/1922 | Schwartz | 2/72 |
| 1,421,162 | 6/1922 | Buckley | 2/71 |
| 1,885,558 | 11/1932 | Smith | 2/69.5 |
| 2,146,400 | 2/1939 | Maker et al. | 2/69 |
| 2,707,988 | 5/1955 | Shaub et al. | 2/69.5 |

FOREIGN PATENT DOCUMENTS

| | | | |
|---|---|---|---|
| 645973 | 7/1928 | France | 2/69 |
| 1373549 | 10/1964 | France | 2/69.5 |
| 550934 | 2/1943 | United Kingdom | 2/69.5 |

*Primary Examiner*—Doris L. Troutman

*Attorney, Agent, or Firm*—Julian Caplan

[57] ABSTRACT

Quilt for use in wheelchairs has a pouch for the feet of the wearer. The back comes up to the back of the knee area. The front fits over the knees and protects the lap. A drawstring tightens the pouch around the knees. An alternate construction splits the pouch into halves so the legs may be spread apart for the comfort of the user. Fasteners permit the halves to be secured together or, alternatively, to secure the front and back together to enclose the halves at the split.

4 Claims, 6 Drawing Figures

QUILT FOR USE IN WHEELCHAIRS

This invention relates to a new and improved quilt for use by patients in wheelchairs or plain chairs at home.

A principal feature and advantage of the invention is the fact that it encloses the feet and lower legs of the user, but does not confine or cramp the feet. The quilt is formed in a pouch which is full at the bottom to accommodate the feet and extends up enclosing both the front and back of the legs below the knees.

Another feature of the invention is the fact that the back of the pouch extends up to the back of the knees, but does not fit under the user between the upper legs and the seat. Accordingly, the quilt is easy to apply and, since it does not have to be tucked under the upper legs, it is not necessary to disturb the user when the quilt is applied. As a matter of fact, the quilt may be applied by the user himself, without the help of an attendant.

Another feature of the invention is that the front of the pouch extends upward and thus covers the lap, keeping the legs warm. A pocket is formed in the lap extension for eyeglasses, books, or other articles either on the inside or outside of the lap extension.

Although the device is intended for use primarily by wheelchair occupants, it may also be used as a laprobe in cold environments or where there are drafts.

In a modification of the invention, the pouch is split in the middle to provide separate enclosures for each leg. In certain types of injuries, it is desirable that the legs be spread apart when the patient is seated in a wheelchair. Splitting the pouch in such manner facilitates spreading the legs apart. In this modification, means is provided for fastening the inner edges of each part together to complete the enclosure thereof. Alternatively, the split may be bridged by joining the adjacent edges of the front of the pouch together and also joining the adjacent edges of the back of the pouch together so that, for practical purposes, the quilt functions as in the first mentioned modification.

Other objects and advantages of the present invention will become apparent upon reading the following specifications and referring to the accompanying drawings in which similar characters of reference represent corresponding parts in each of the several views.

Figure 3:
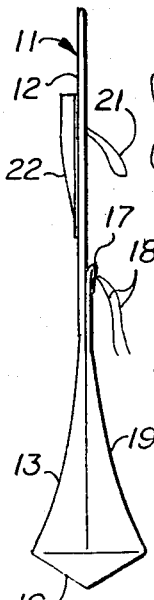
FIG. 3 is a side elevational view of the structure of FIG. 2.

Quilt 11 consists of an upper or lap portion 12 and a lower or pouch portion 13. Back panel 14 extends up from the bottom 16 to a hem 17 sewn to the back of the lap portion 12. Directing attention particularly to FIG. 3, it will be seen that there is a fullness in the bottom 16 which occurs between panels 13 and 14 to accommodate the feet of the user. Drawstrings 18 in the hem 17 may be pulled to gather the pouch between the panels 13 and 14 around the knees of the user. Drawstrings 18 may also be used to tie the quilt to the chair, if desired.

Loops or ties 21 may be tacked to the lap portion 12 and secured to part of the structure of the wheelchair 41, or otherwise engaged to keep the lap portion 12 in proper place.

Figure 1:
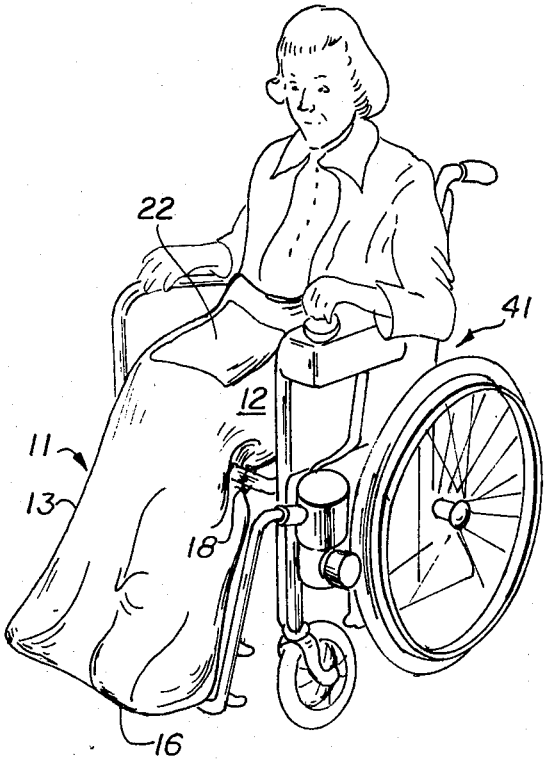
FIG. 1 is a prospective view showing use of the quilt by a patient in a wheelchair.

Directing attention to FIG. 1, after the patient is seated in the wheelchair 41 (or other chair) the legs may be inserted in the pouch between the panels 13 and 14 without the necessity of the patient rising or being lifted from the chair 41. Thereupon, the drawstrings 18 are tightened and the quilt 11 remains snugly around the knees. The lap panel 12 extends over the lap of the wearer and the pocket 22 (which may be either on the inside or outside of lap panel 12) is accessible. Preferably, the loops or ties 21 secure the lap portion in position. It will be seen that if the patient has sufficient use of the limbs it is unnecessary for an attendant to insert the legs in the pouch. Hence, although the quilt 11 has usefulness especially for wheelchair occupants, nevertheless users seated in drafty or cold places may use it as a laprobe.

Figure 4:
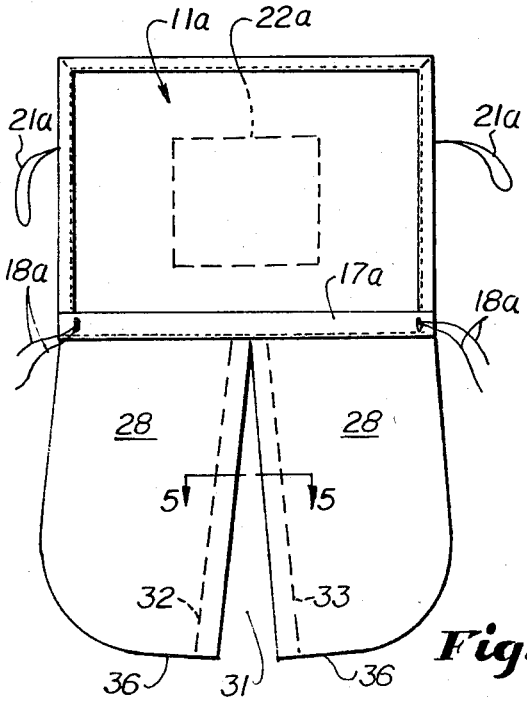
FIG. 4 is a bottom plan view of a modification wherein the pouch is split.
Figure 5:
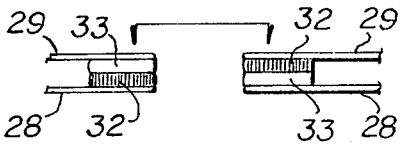
FIG. 5 is a sectional view taken substantially along the line 5—5 of FIG. 4 showing fastening means to fasten the inner edges of each leg portion of FIG. 4.
Figure 6:
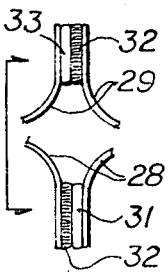
FIG. 6 is a view similar to FIG. 5, showing how the adjacent portions may be joined together.

As has previously been mentioned, in certain conditions it is desirable that the knees of the patient be spread apart. A modification useful in such situations is shown in FIGS. 4–6. Thus there is a split 31 up the center of the pouch and there are rear panels 28 on either side of split 31 which accomplish the same purpose as the panel 14 in the previous modification. The front of the quilt 11A has two front panels 29 congruent with panels 28.

It is desirable to close the edges of the lower portion of the pouch of the modification of FIG. 4. One suitable means is the application to each of the edges of "Velcro" or equivalent material. Thus the margin of the split 31 is provided with a continuous strip or an intermittent strip of the spiny Velcro portion 32 and the opposite panel with the felt-like material 33. As is apparent from FIG. 5, the positions of the spiny and felt-like materials are reversed on opposite sides of the split 31.

Figure 2:
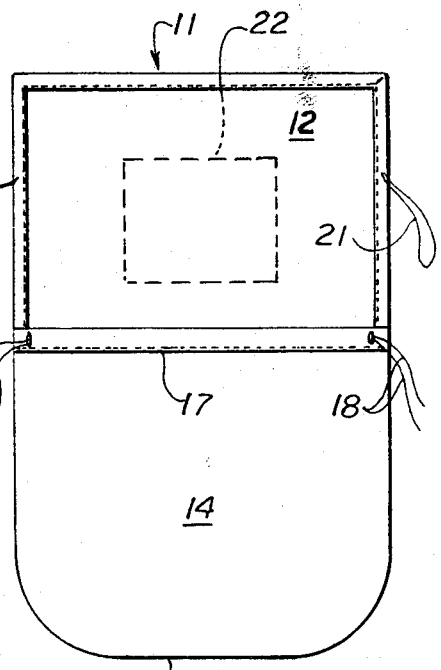
FIG. 2 is a rear elevational view of the quilt laid flat.

When it is not necessary to divide the legs of the modification of the quilt 11A, the Velcro materials 32, 33 of the front panels 29 may be joined together and similarly the Velcro portions 32, 33 of the rear panels 28 may be joined together. When thus joined, as shown in FIG. 6, the modification of FIG. 4 functions similar to the modification of FIG. 2. It will be understood that fastening means other than Velcro material may be employed. Thus button, snap, slide fasteners and other means may be substituted. In many respects, the modification of FIGS. 4–6 resemble the modification of FIGS. 2–3 and the same reference numerals followed by the subscript (a) are used to designate corresponding portions.

By choice of materials, the quilt may be of different weights for use under different temperature conditions or may be made of waterproof or water-repellent material for use in inclement weather.

As stated herein, although the claims refer to wheelchair occupants, the device may be used in regular chairs and lounges.

What is claimed is:

1. A quilt for use by wheelchair occupants, comprising a pouch for the lower legs of the occupant having a back panel which extends up behind the legs of the occupant and terminates at the back of the knees without extending under the buttocks, a front panel extending up over the knees and lap of the occupant, the bottom of the pouch being wide enough for the feet of the occupant, said back panel having a hem at the top and a drawstring in said hem to draw said hem around the knees of the occupant, aid hem being formed with openings at either side, said drawstring extending out through said openings.

2. A quilt according to claim 1 which further comprises ties at the upper portion of said front panel, said front panel being provided at its middle with a pocket.

3. A quilt according to claim 1 which further comprises fastening means on the inner edges of said portions operable to fasten said portions in either of two positions, one position joining each front portion to the back portion immediately behind said front portion, the other position joining the two front portions together and the two back portions together.

4. A quilt for use by wheelchair occupants having a back panel which extends up behind the legs of the occupant and terminates at the back of the knees without extending under the buttocks, a front panel extending up over the knees and lap of the occupant, the bottom of the pouch being wide enough for the feet of the occupant, both said front and back panels being split from the bottom up to about the knees into separate portions to permit spreading of the legs of the occupant.

* * * * *